United States Patent [19]

Hodne

[11] 3,935,938

[45] Feb. 3, 1976

[54] LINE FEED MECHANISM FOR PRINTER

[75] Inventor: Ingard B. Hodne, Northbrook, Ill.

[73] Assignee: Teletype Corporation, Skokie, Ill.

[22] Filed: Apr. 7, 1975

[21] Appl. No.: 565,928

Related U.S. Application Data

[63] Continuation of Ser. No. 468,048, May 8, 1974, abandoned.

[52] U.S. Cl. ..... 197/114 R; 197/1 R; 197/133 R; 74/354; 226/37

[51] Int. Cl.[2] ..... B41J 19/92

[58] Field of Search ..... 197/1 R, 114, 120, 127 R, 197/133 R, 133 P; 74/112, 354, 413; 226/37

[56] References Cited

UNITED STATES PATENTS

| | | | |
|---|---|---|---|
| 2,168,448 | 8/1939 | Pitman | 197/66 |
| 3,272,303 | 9/1966 | Pohl | 197/114 R |
| 3,428,160 | 2/1969 | Barkdoll | 197/114 R |
| 3,686,974 | 8/1972 | Little | 74/354 X |
| 3,804,014 | 4/1974 | Thiene et al. | 101/269 |

*Primary Examiner*—Edgar S. Burr
*Assistant Examiner*—Paul T. Sewell
*Attorney, Agent, or Firm*—J. D. Kaufmann; J. L. Landis

[57] ABSTRACT

A line feed mechanism for use with high speed, lead screw driven printers, such as of the dot matrix type, utilizes a solenoid with a dual pivotal armature to effect the coupling of a uniquely mounted and eccentrically displaceable platen gear to a lead screw connected gear. As such, single or multiple platen controlled line feeding is effected in a manner which is correlated with the linear advancement of the carriage-mounted and lead screw-driven print head. The pivotal armature, when actuated, is also employed to hold a detent lever out of engagement with a ratchet wheel associated with the platen during multiple line feeding. This advantageously obviates the "clatter" sound otherwise generated, with but one solenoid being required for both variable line feeding and ratchet wheel release. As the stepping motor for the lead screw may be readily controlled for bi-directional rotation, so to may the silently operated platen be rotated, independently of carriage position, so as to allow various specialized printing and line scanning operations to be performed.

17 Claims, 11 Drawing Figures a b c d e
X

LOGIC CONTROLLED PULSE GEN.
151
15
16
17
18
19
20
21
22
23
24
30
31
37
39
49
51
61
61a
67
67a
71
77
81
81a
87
92
95
97
102
107
109
111
116
126
144
X
Y
Z

FIG. 3
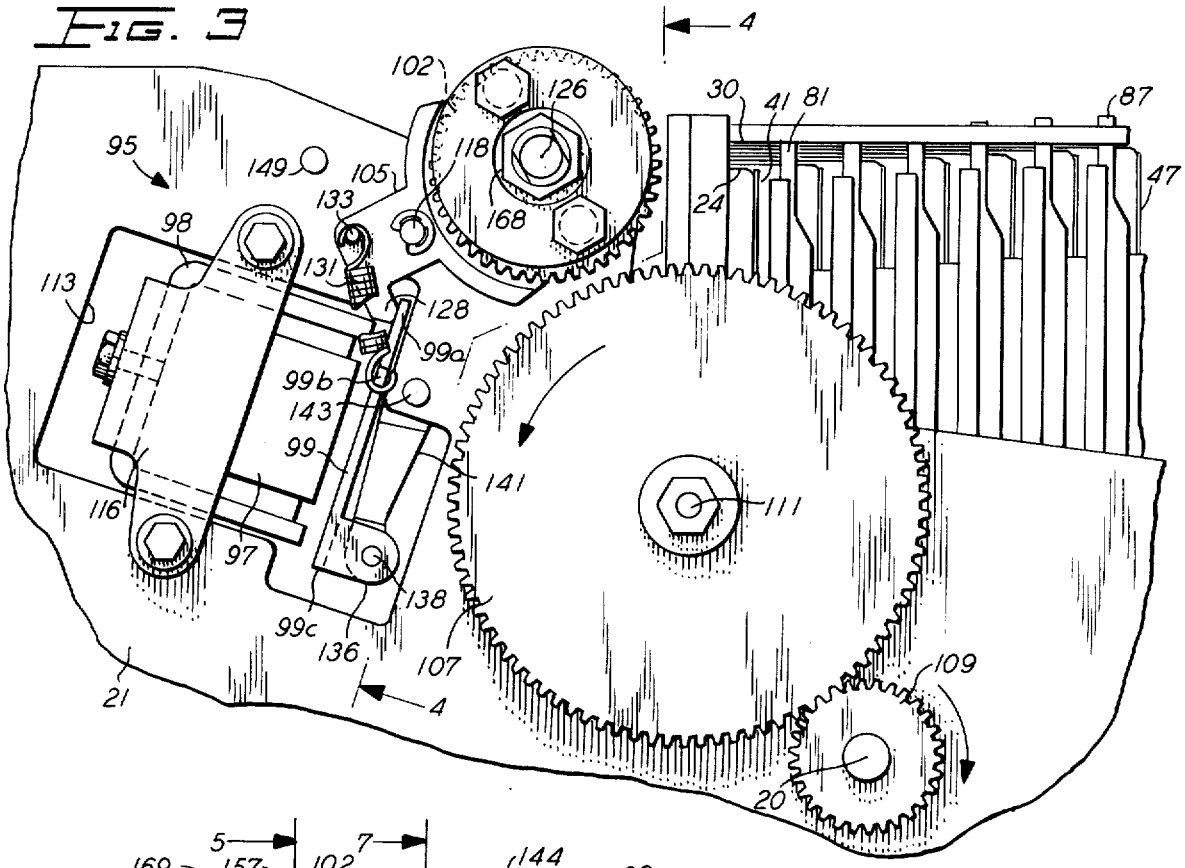
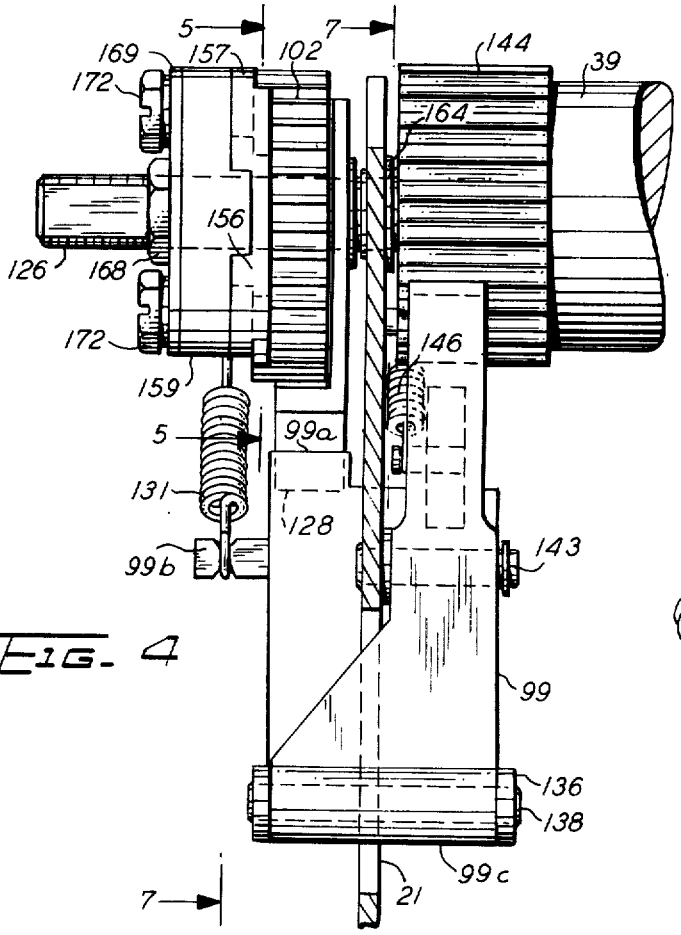
FIG. 4
FIG. 5
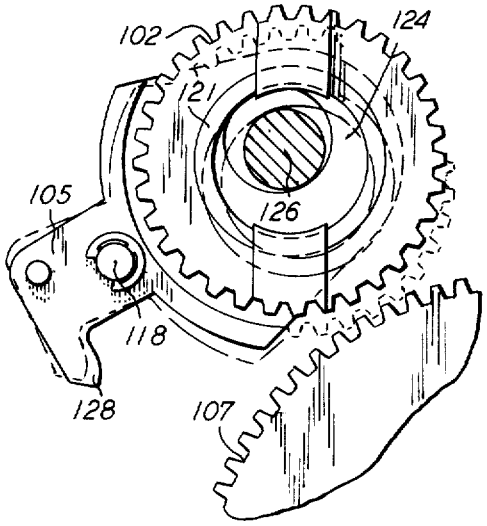

LINE FEED MECHANISM FOR PRINTER

This application is a continuation of my copending application, Ser. No. 468,048, filed May 8, 1974, now abandoned.

BACKGROUND OF THE INVENTION

1. Field of the Invention

The present invention relates to printer apparatus and, more particularly, to a line feed mechanism therefor.

2. Description of the Prior Art

There have been a number of different types of automated line feed mechanisms proposed and/or employed heretofore to periodically rotate a typewriter or a printer platen and, thereby, through frictional (or sprocket wheel) contact with a worksheet (or roll of paper) advance the latter either one or a limited pre-set number of line spaces periodically, normally dependent on each return of the carriage to its "home" position. Such mechanisms, for example, have often employed a cam-actuated pawl and ratchet wheel assembly, which has relied on the inertia produced by either a spring or a power returned carriage, to effect incremental single up to triple print line rotation of the platen.

In still other prior line feed mechanisms, a laterally movable stop or detent, often supported on a reciprocally driven carriage, has been employed to trip or otherwise actuate either associated mechanical or electromechanical apparatus which, in turn, effects line feed rotation of the platen. In the latter case, the platen has generally been rotated by the use of either an actuated pawl-ratchet wheel assembly, or by an operable clutch that incorporates an axially displaceable and rotatably driven member.

In all of such prior line feed mechanisms, line feeding is obviously only initiated when the carriage passes or arrives at a given point along its path of travel, and even then, usually from only a given direction. Such a point of carriage initiated platen rotation is typically located at or near the first print column position of the printer. It is thus seen that many line feed mechanisms employed heretofore have not provided selectively controlled, multiple line feeding versatility, i.e., where a number of print line advancements of a print medium much greater than two or three, for example, may be selectively produced, even when dependent on a return of a carriage to its "home" or some other preselected position.

This deficiency in line feed versatility has been particularly evident in high speed printers of the dot matrix type. In such printers, a carriage mounted print head is either stepped or continuously driven at a relatively rapid rate from one side of the platen to the other during the printing of a given line and, thereafter, generally driven even more rapidly to its starting or "home" position to commence the printing of the next line of information. Because of the speed of such printers, they are often used as peripheral equipment in computer systems, or as part of terminal station apparatus and, hence, are often involved in printing applications where very rapid multiple line feeding would be a great advantage, such as in formating, vertical tabulating or editing operations.

Even if prior line feed mechanisms were modified in some way to effect variable multiple line feeding, another problem that would normally exist is the noise (or clatter) that would be generated by the ratchet-detent mechanism necessarily employed to accurately and firmly hold the platen (and paper) during the printing of each line. Such noise can become very pronounced and objectionable in high speed printers, such as of the dot matrix type. By reason of the nature and manner in which most prior line feed mechanisms operate, to also selectively bias the detent in question out of engagement with the ratchet wheel during multiple line feeding would normally require separate poweroperated apparatus, such as an operably coupled solenoid, which would not only increase the cost and space requirements of, but the power consumed by, the composite line feed mechanism.

An additional problem that would be encountered in any attempt to modify most prior line feed mechanisms for more versatile, automated single and multiple line feeding applications, is the fact that such apparatus in its present form has tended to be rather complex mechanically, expensive and bulky. Such apparatus therefore does not readily lend itself to further modification and/or the incorporation of additional apparatus to effect selectively controlled and quiet multiple line feeding, and still readily be accommodated within the very close fitting housings of most high speed printers today. Such compactness, of course, is attributable in large measure to the utilization of solid state logic circuitry to control the printing operations. It, of course, is recognized that optimum line feed versatility could be achieved by utilizing a separate stepping motor to selectively rotate the platen of a printer independently of the power driven carriage. The cost of an additional stepping motor, as well as the space requirements therefor, however, would normally rule out that solution to line feeding in the highly competative field of high speed, low cost and compact carriage driven printers.

SUMMARY OF THE INVENTION

Thus, one object of the present invention is to provide an improved line feed mechanism in a printer having a rotatable drive gear. The feeder effects either single or multiple line feed modes of a platen in accordance with a line feed signal. The improved feeder includes a gear, the rotational axis of which is shiftable from a first normal position to a second position. In the first position the gear is concentric with the platen and out of engagement with the drive gear. In the second position the gear engages the drive gear and is eccentric to the platen. A modified Oldham coupler permits this eccentricity while continuously rotationally coupling the gear to the platen. An inhibitor normally prevents free rotation of the platen. A shifter shifts the gear axis to the second position to engage the drive gear and rotate the platen in response to a line feed signal. If the signal persists longer than is necessary to effect single line feed, facilities are provided to disable the inhibitor to permit free platen rotation until the line feed signal ceases.

It is a further object of the present invention to provide a versatile line feed mechanism for use in high speed printers that can be readily controlled to effect single or variable multiple line feeding in a manner that is correlated with the travel of an associated carriage, and with a very low degree of noise.

It is another object of the present invention to provide a versatile line feed mechanism not only of simplified, rugged and compact size, but which is of inexpensive design, minimizes power requirements and does not require any pre-set mechanical or electrical adjustments of apparatus at fixed positions along the path of travel of a carriage to effect line feeding.

In accordance with one preferred embodiment of the present invention, these and other objects are accomplished through the utilization of a solenoid with a dual pivotal armature and a uniquely mounted platen gear. More specifically, and with reference to use in one illustrative lead screw driven dot matrix printer, upon energization of the solenoid, the armature is pivoted from a first nonactuated position to a second position to effect the coupling of the platen gear to a drive gear coupled to the lead screw of the printer. Immediately thereafter, the armature of the still energized solenoid is pivoted from the second position to a third position so as to also hold a detent lever, after having been cammed out of engagement with a then rotated ratchet wheel (secured to the platen of the printer), in a non-contacting position until the solenoid is de-energized.

The platen gear comprises part of a modified "Oldham" coupling and, as such, may advantageously be eccentrically displaced, relative to the platen support shaft, into periodic engagement with an associated driving gear, while remaining continuously rotatably coupled to the platen shaft. The timing of such platen gear engagement is preferably correlated with a momentary pause or stepped advance of an associated carriage.

Such a line feed mechanism is thus seen to provide very quiet multiple line feeding which at all times is correlated with the travel of the carriage in either direction along a given print line. The present mechanism is also of simplified and inexpensive design, and consumes a minimum amount of power as only one non-power driving solenoid is required, that being to control two different operating functions in a very unique manner, namely, selective variable line feeding and ratchet wheel release. Further, as the stepping motor for the lead screw of the printer may be readily controlled for bi-directional rotation, so too may the silently operated platen be driven to accomplish more efficiently any one of a number of desired high speed line printing and scanning operations.

BRIEF DESCRIPTION OF THE DRAWINGS

FIG. 3 is an enlarged, side elvational view of the line feed mechanism, and particularly illustrates the relative positions of the dual pivotal armature of the solenoid and the platen gear when not coupled through the intermediate gear to the lead screw of the printer of FIG. 1;

FIG. 4 is an enlarged, detail front elevational view, partially in section, taken along the line 4—4 of FIG. 3, of the main parts of the line feed mechanism;

FIG. 5 is an enlarged, detail view, partially in section, taken along the lines 5—5 of FIG. 4, illustrating the non-engaging and engaging (phantom line) positions of the platen gear relative both to the intermediate gear and platen support shaft;

DETAILED DESCRIPTION OF THE INVENTION

Background - Matrix Printer Construction

Figures 1, 2:
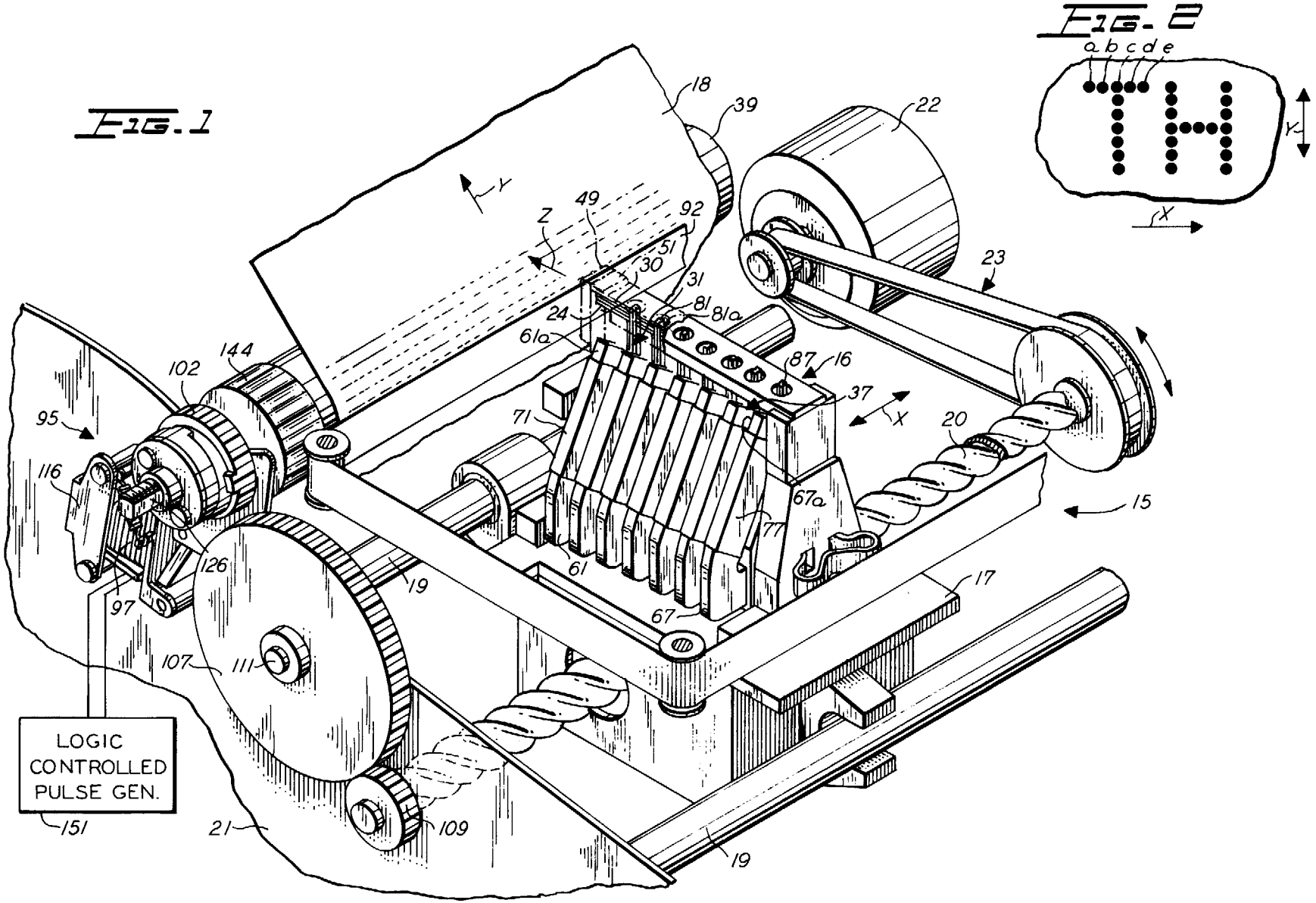
FIG. 1 is a partially broken away perspective view of an illustrative high speed dot matrix printer, with some parts being omitted for the purpose of illustrating a unique line feed mechanism embodying the principles of the present invention.
FIG. 2 is an enlarged representation of two typical dot matrix alphabetic characters as produced on a print medium by the printer of FIG. 1.

As previously mentioned, the line feed mechanism embodied herein has universal application, but for purposes of illustration, it is disclosed in connection with a high speed dot matrix printer 15 of the type depicted in FIG. 1, and disclosed in greater detail in a commonly assigned and concurrently filed copending application of J. L. DeBoo-E. C. Feldy-H. S. Grear, Ser. No. 468,046, herein incorporated by reference. Such a printer is of the class wherein a print head 16 is mounted on a carriage 17 for lateral reciprocal movement in a horizontal direction (X) in front of and across the width dimension of a web 18, such as paper in roll stock form, or any other suitable record medium on which printing is to take place.

The carriage 17 is driven along a pair of guide rods 19—19 by means of a reversible, rotatably driven lead screw 20 which is coupled to the carriage by any suitable means, such as a drive nut (not shown herein). For more details about one preferred drive nut-carriage assembly applicable for use with a lead screw operated matrix printer, reference is made to a commonly assigned and concurrently filed copending application of A. F. Lindberg, Ser. No. 468,047, herein incorporated by reference.

The lead screw 20 is suitably journalled at opposite ends in frame structure, such as side plates 21 (only one partially shown), for rotation, and is reversibly driven by a power source 22, such as a stepping motor, through a suitable drive train which, as depicted, comprises a belt-pulley assembly 23. It should be appreciated that as far as the present line feed mechanism embodied herein is concerned, the carriage mounted print head 16 may be stepped to each successive print column position during printing, or driven at a constant speed therealong, with the return of the print head to the "home" position being accomplished at the same or preferably at a faster speed.

In the present illustrative printer embodiment, the print head 16 includes a vertical column of typically seven print wires, only the bottom and top ones being respectively identified by the numerals 24 and 30 in FIGS. 1 and 3, for use in a 5 × 7 dot matrix format (or nine wires in a 5 × 9 matrix). The print wires are selectively actuated by a respectively associated electromagnetic actuator assembly, only the first and last of seven being respectively identified by the numerals 31 and 37 in FIG. 1. These assemblies are arranged in a compact, horizontally spaced and vertically stepped array so as to correspondingly position the essentially horizontally disposed print wires 24–30 in a stepped and vertically stacked array as best seen in FIG. 3. For example, actuator assembly 31 is lowermost and is closest to a platen 39 (FIG. 1), whereas the actuator assembly 37 is uppermost and furthest from the platen.

As best seen in FIG. 3, each of the actuator assemblies 31–37 includes an associated one of a corresponding number of outwardly extending and pivotal flat-spring armatures, only the upper portions of each being shown, and only the first and last of which are respectively identified by the numerals 41 and 47. Each of the print wires 24-30 is connected to the upper end of the associated one of the armatures 41–47 in such a manner that the armatures alternately and selectively cock (or retract) the associated wires in a multi-bored guide block 49, supported on a face plate 51, and "fire" the print wires in the designated Z direction as required for printing.

Considered more specifically, each of the armatures 41–47, preferably in the form of a flat spring of ferromagnetic material, is affixed at its lower end (not shown) to the base of an associated one of a plurality of essentially triangularly shaped magnetic cores, only the first and last ones of seven being respectively identified by the numerals 61 and 67 in FIG. 1. The upwardly and inwardly extending leg portions of each core terminate so as to define a pair of spaced, free-ended pole faces which are positioned on the rear side of, and when not magnetized, spaced a short distance from the upper end of the particular armature associated therewith. With the armatures 41–47 and corresponding cores 61–67 constructed and arranged as described, it is seen that the armatures are free to pivot or flex in an arcuate path toward or away from their respectively associated core pole faces, which direction depending on the presence or absence of a magnetizing force.

The requisite magnetizing force for attracting each of the armatures 41–47 against its associated magnetic core pole faces is effected by an associated pair of series connected coils, only one coil of the first and last of seven pairs being respectively identified by the reference numerals 71 and 77 in FIG. 1. The coils of each pair are respectively co-axially mounted on the two upwardly and inwardly extending leg portions of each associated magnetic core, and when energized, such as by a suitable control pulse from a logic control circuit (not shown), cause the upper end of the particular one of armatures 41–47 associated therewith to be retracted or cocked, in a spring-biased manner, against the then magnetized pole faces of the associated core. The resulting spring-biased stored energy in each of the armatures 41–47 is thereafter utilized to "fire" the associated one of the print wires 24–30 coupled thereto in the Z direction during a printing operation. Such firing is preferably effected when a momentary release pulse of opposite polarity is applied to the pair of coils associated with the particular armature to be released.

To further assist in maintaining the print wires 24–30 in proper alignment during their selective retractable movement, the opening at the upper apex of each of the cores 61–67 accommodates an associated vertically extending wire guide member, only the first and last of seven being respectively identified by the numerals 81 and 87, with each having a wire slot formed therein, such as 81a seen in FIG. 1. With the wire guides arranged in such a stacked array, it is seen in FIG. 3 that while the lower print wire 24 (nearest the platen) does not pass through the slot in any guide member, the top print wire 30 (furthest from the platen 39), passes through the respective slots in all seven guide members.

As far as understanding the line feed mechanism of the present invention is concerned, it will suffice to simply state at this point that in the case of a 5 × 7 dot matrix print head 16 of the type depicted in FIGS. 1 and 3, the carriage 17 is stepped or displaced five horizontal dot positions for every character print column. During each such advancement, selected ones of the seven print wires 24–30 are actuated or "fired" on-the-fly so as to drive the ends thereof against an inked ribbon 92, and the latter against discrete portions of the paper 18, thereby effecting the printing of a dot matrix character corresponding to the actuated print wires. For example, and with reference to FIG. 2, it is seen that the top leg portion of the letter T in a 5 × 7 dot matrix format requires dots in all five possible horizontal dot positions identified *a* to *e*, and the center leg portion thereof requires dots in all seven possible vertical dot positions. Similarly, two vertical legs of seven dots and one horizontal leg of five dots are required for the letter H.

Figures 9, 10, 11:
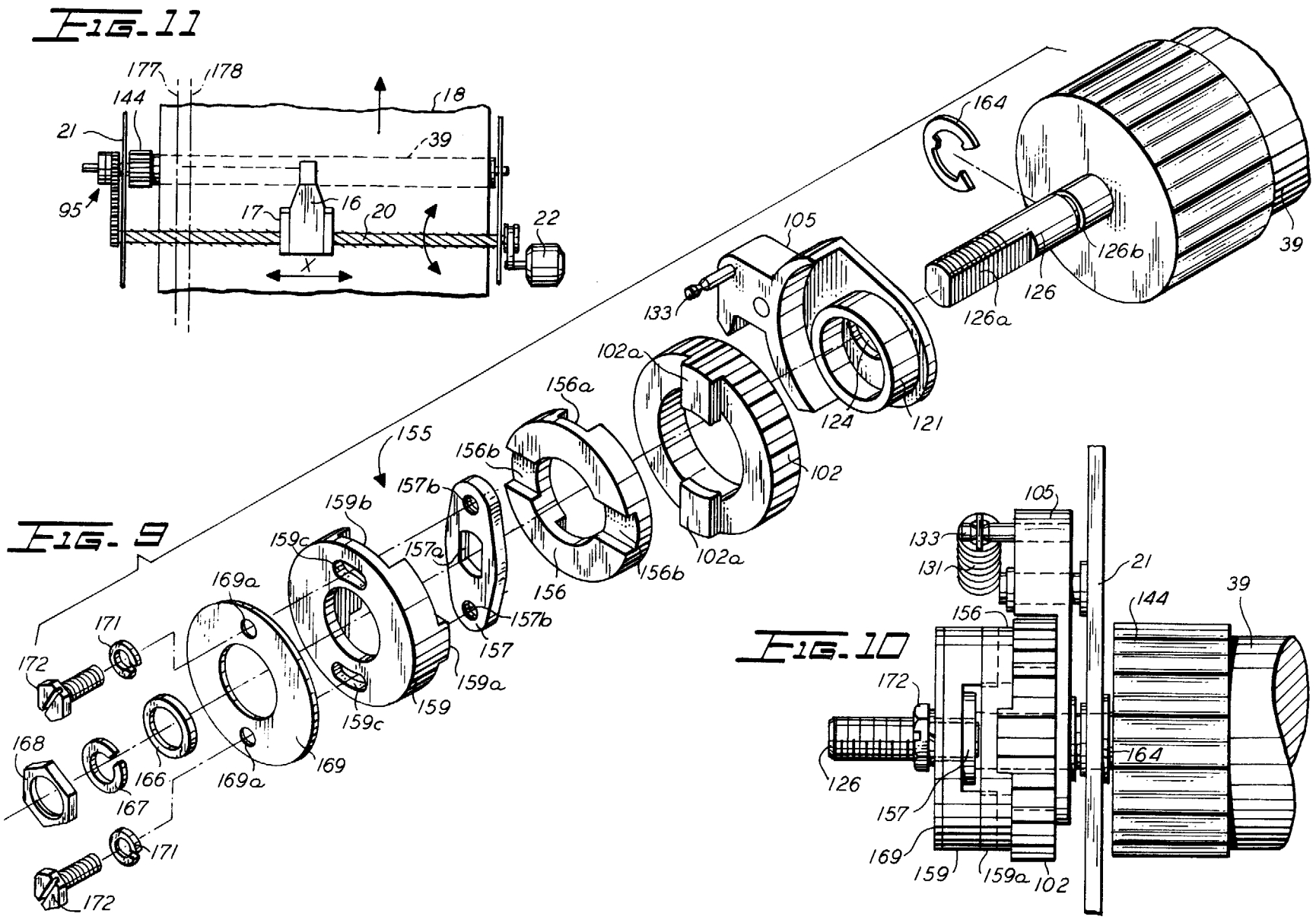
FIG. 9 is an enlarged, exploded perspective view of the main parts of the line feed mechanism that are mounted on and rotatable with the platen support shaft, including the eccentrically displaceable platen gear.
FIG. 10 is an enlarged, plan view of those parts of the line feed mechanism depicted in FIG. 9.
FIG. 11 is a symbolic representation of the lead screw driven print head of the printer depicted in FIG. 1, and illustrates the period in time and the position of the print head when the line feed mechanism embodied herein is preferably operated to effect normal single line feeds.

After a desired number of dot matrix characters have been printed in a given line, the carriage 17 is rapidly returned to a "home" position, to the left as viewed in FIGS. 1 and 11, at which time a line feed takes place, i.e., the paper 18 is stepped or advanced one or more line printing spaces in the Y direction, in preparation for printing a new line of character information. As will be described in greater detail hereinafter, it is advantageous to effect line feeding after the carriage and print head has been indexed at least one character column space to the left of the regular margin along which printing is to take place.

For a more detailed description of the abovedescribed print head, as well as suitable operating control circuitry for actuating the print wires, none of which is critical or important with respect to an understanding of the line feed mechanism of particular concern herein, reference is made to the aforementioned DeBoo et al. copending application, and to the patents of P. A. Brumbaugh et al., U.S. Pat. Nos. 3,672,482, A. S. Chou et al., 3,592,311 and R. S. Bradshaw, 3,217,640.

Line-Feed Mechanism

With the foregoing general description of the dot matrix printer as background, attention will now be directed to a new and improved line feed mechanism 95 for use therewith which embodies the principles of the present invention. With reference first to FIGS. 1 and 3, it is seen that the line feed mechanism 95 for periodically feeding the paper 18 selectively one or more lines at a time includes a solenoid 97, with a dual pivotal armature 99, a platen gear 102, a pivotal lever 105, an intermediate gear 107, and a lead screw gear 109, all mounted directly or indirectly on the side frame member 21 (only partially shown) of the printer 15.

Considered more specifically, the intermediate gear 107 is rotatably mounted on a stub shaft 111, secured to the side frame member 21, and is positioned so as to be in continuously coupled engagement with the lead screw gear 109, mounted on one end of the lead screw 20. The solenoid 97 is recessed within an accommodating opening 113 (FIGS. 3 and 6) of, and suitably secured by a bracket assembly 116 to, the side frame member 21.

As best seen in FIGS. 3 and 5–7, the platen gear lever 105 is pivotally supported on a stub shaft 118 secured to the side frame member 21 and, as best seen in FIG. 9, has an upper end formed with a hub 121 on which the apertured platen gear 102 is mounted for rotation. The hub 121 has an over-sized aperture 124, best seen in FIG. 5, which allows the hub and, thereby, the platen gear 102 mounted thereon, to move eccentrically (or essentially radially) relative to a support shaft 126 of the platen.

The lower end of the platen gear lever 105 is formed with a detent 128 that is continuously spring-biased against an upper end 99*a* of the dual pivotal armature 99, by means of a coil spring 131. The latter is connected at one end to a pin 133 suitably secured to the lever 105 and at the other end to an outwardly extending tab 99*b* formed as an integral part of the armature 99 (see FIGS. 3, 4, and 6).

Figure 6:
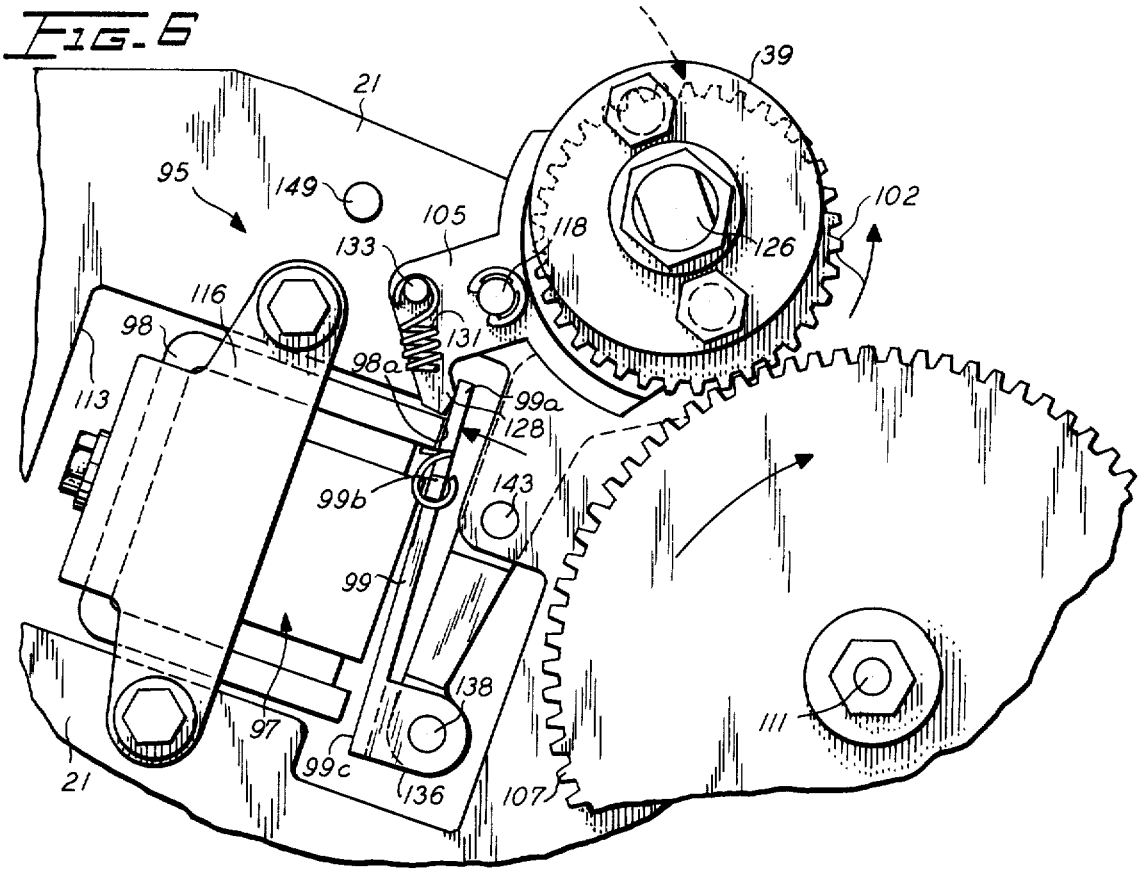
FIG. 6 is an enlarged, side elevational view of the line feed mechanism embodied herein and illustrates in particular the relative positions of the dual pivotal armature of the solenoid and the platen gear when coupled to the intermediate gear to effect rotation of the platen.
Figure 7:
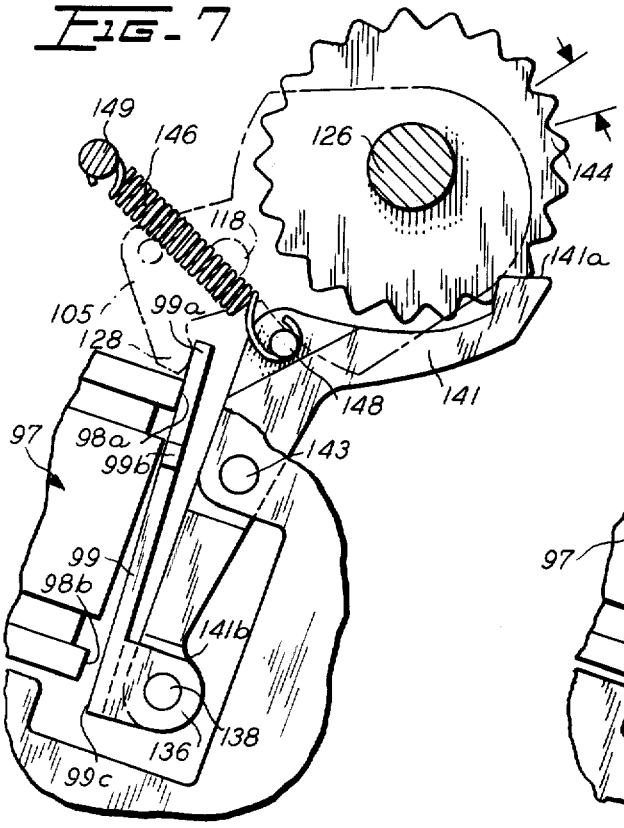
FIGS. 7 and 8 are enlarged, fragmentary detail views, partially in section, taken along the line 7—7 of FIG. 4, with FIG. 7 illustrating the relative positions of a resilient locking pawl and platen ratchet wheel when no line feeding is taking place, and with FIG. 8 illustrating the relative positions of the same parts during multiple line feeding.

As best seen in FIGS. 3, 6 and 7, the armature 99 has a lower end 99c formed with a flange 136. This flange is pivotally coupled by a pin 138 to one end of a detent lever 141 (best seen in FIGS. 7 and 8). The detent lever 141 is mounted for pivotal movement about a stub shaft 143 secured to the side frame member 21 of the printer, and is normally spring-biased against a ratchet wheel 144 by means of a coil spring 146. The latter spring is connected at one end to a pin 148, secured to an intermediate region of the detent lever 141, and at the other end to a pin 149 secured to the side frame member 21.

With the detent lever 141 mounted and biased in this manner, it normally resiliently holds the ratchet wheel 144 and, thereby, the platen 39, in a fixed rotational position during each line printing period defined between successive line feeds. As will presently be seen, and in accordance with the principles of the present invention, the detent lever 141 is readily held out of engagement with the ratchet wheel 144 whenever multiple line feeding is desired so as to eliminate the generation of an otherwise annoying "clatter" sound. With respect to the ratchet wheel 144, it may be either formed in a peripheral end region of the platen 39 as an integral part thereof, or secured thereto as illustrated, by any suitable fastening means.

Attention is now directed in greater detail to the manner in which the platen gear 102 is constructed, mounted and coupled for rotation relative to the support shaft 126 of the platen 39. With particular reference to FIG. 9, it is seen that the platen gear 102 actually forms part of a modified "Oldham" coupling, identified generally by the reference 155. As embodied in such a coupling, the platen gear 102 advantageously may be eccentrically displaced, relative to the platen shaft 126, into periodic engagement with the intermediate gear 107 (see the relative positions thereof in FIGS. 3 and 6), while remaining continuously rotatably coupled to the platen shaft. Such a uniquely operable platen gear greatly simplifies the construction of the line feed mechanism. More specifically, if that gear were rigidly secured to the platen shaft, then two additional gears, at least one of which would have to be mounted for operable displacement, would normally be required to couple the platen gear to the oppositely rotated intermediate gear 107.

The platen shaft 126, in addition to the platen gear 102 and the pivotal lever 105 on which the gear 102 is rotatably mounted, also includes an intermediate coupling member 156, a shaft locking member 157 and an outer shaft-coupled member 159. Considered more specifically, the platen gear 102 has an outwardly protruding pair of diametrically disposed ribs 102a that nest within a pair of respectively aligned and accommodating recesses 156a formed in the intermediate coupling member 156. Similarly, the outer coupling member 159 has a pair of diametrically disposed ribs 159a that are received within a pair of aligned and accommodating recesses 156b formed in the adjacent side of the intermediate coupling member 156.

As also best seen in FIG. 9, not only the central aperture 124 in the hub of the pivotal lever 105, but the central aperture in the intermediate coupling member 156 are oversized relative to the diameter of the platen shaft 126 so as to allow eccentric, or essentially radial, displacement of these parts relative to the platen shaft (see FIG. 5). The locking member 157 has a rectangular central aperture 157*a* that allows that member to be mounted on the platen shaft 126 for engagement with complementarily shaped flat sides 126*a* of the shaft 126.

The pivotal lever 105, platen gear 102 and intermediate coupling member 156 are all held in a stacked or sandwiched relationship between a C-ring 164, snapped onto a groove 126*b* formed in the platen shaft 126, and the locking member 157 by means of a support washer 166, a lock washer 167 and a shaft nut 168. The latter is threadably advanced along the threaded end of the support shaft 126 until it firmly biases the lock washer 167 against the adjacent surface of the support washer 166, and the latter against the locking member 157 (see FIGS. 4 and 9).

The outer coupling member 159 has a central aperture that allows that member to be coaxially mounted on the peripheral edge of the support washer 166. The member 159 is rigidly coupled to the platen support shaft 126 for rotation therewith by means of a flat washer 169, two locker washers 171 and two respectively associated threaded screws 172. The screws respectively extend through aligned holes 169*a* formed in the flat washer 169 and aligned arcuate slots 159*c* formed in the outer coupling member 159, and terminate in aligned tapped holes 157*b* formed in the locking member 157. In order for the flat washer 169 to be biased firmly against the coupling member 159, the former has an oversized central aperture so as to accommodate the previously assembled shaft nut 168 therewithin (see FIG. 6).

The arcuate slots 159*c* are employed to initially angularly orient the coupling member 159 and, as a result, also orient the intercoupled platen gear 102 such that the teeth in the latter will mate with the teeth in the intermediate gear 107 (see FIG. 6) at the same time that the pawl end 141*a* of the detent lever 141 is positioned between two adjacent teeth in the ratchet wheel 144 (see FIG. 7). As such, an initial angular phase adjustment may be readily made to correlate the linear position of the lead screw driven carriage 17 with the angular position of the platen 39 relative not only to the first, but to each successive character print column position to which the carriage 17 is advanced thereafter.

From the foregoing, it is seen that structurally the line feed mechanism 95 as embodied herein advantageously affords a number of significant advantages over prior line feed mechanisms in terms of simplicity, cost, compactness and positive gear-coupled reliability. In connection with cost and reliability, it should be appreciated that all of the main parts comprising the modified "Oldham" coupling 155, with the possible exception of the locking member 157, may advantageously be molded out of plastic, primarily because of the limited periods in which the composite coupling unit is actually rotated, and even then at relatively low speeds. As such, there is minimum wear of the moving parts of the line feed mechanism, whether made of metal or plastic and, hence, the mechanism provides long life reliability.

With the structural features of the line feed mechanism 95 having been fully described, attention will now be directed to the manner in which the mechanism operates, and to the significant benefits derived therefrom. Either single or multiple line feeding is readily accomplished by simply controlling the time during which the single, small, low-current rated solenoid 97 is energized. The solenoid may be of small size, of course, because it does not have to furnish any driving power to rotate the platen. Selective energization of the solenoid 97 is preferably accomplished by logic controlled pulses supplied from a pulse source 151 (see FIG. 1), which may be of conventional design and operated either independently of or in consort with the logic control circuitry (not shown) for actuating the print wires, and for operating the stepping motor 22 which, of course, controls the movements of the lead screw driven carriage 17. In any event, single or multiple line feeding may be readily initiated by simply applying a control pulse at the proper time, and for the necessary time period, to the solenoid 97.

When the solenoid 97 is energized, the armature 99 thereof is pivoted from the position depicted in FIG. 3 to the position depicted in FIG. 6. Such pivotal movement of the armature 99, in turn, causes the platen gear lever 105, together with the platen gear 102 mounted on the hub 121 thereof (see FIG. 9), to be pivoted about the supporting stub shaft 118 from the position shown in FIG. 3 to that shown in FIG. 6, whereat the platen gear is in engagement with and rotated by the intermediate gear 107. Pivotal movement of the platen gear lever 105 is effected, of course, by the upper end 99*a* of the armature being cammed against the detent portion 128 of the lever 105, while the adjacent end of the armature is being pulled by magnetic attraction against the adjacent pole face 98*a* of the U-shaped solenoid core 98.

A very significant advantage derived from utilizing the solenoid-actuated and eccentrically displaceable platen gear 102 is that it may be brought into engagement with the lead screw driven intermediate gear 107 in a very rapid and positive manner at any time and, thus, need not be dependent on or controlled by the position or direction of movement of the carriage 17. However, in a preferred mode of operation, the platen 39 is normally rotated to effect line feeding only after the carriage has been momentarily stopped, such as after a stepped advancement thereof, with the number of line feeds thereafter preferably being correlated with the number of either stepped or constant speed character column advancements of the carriage 17 produced by the energized stepping motor. Operated in this manner, the normally non-rotating platen gear is never brought into engagement with the intermediate gear while the latter is rotating. As such, both gear-coupling timing problems and gear teeth wear are minimized.

Considering now the correlated movements of the platen and carriage more specifically, the gear ratio between the platen gear 102 and the lead screw gear 109 (best seen in FIGS. 1, 3 and 6) is preferably chosen so that for each character column advancement of the carriage 17 along the guide rods 19, the platen is rotated one line space. Accordingly, there may be as many line feed advancements of the paper 18 as there are character column advancements of the carriage. For example, if the control signal is applied to the stepping motor 22 for a period of time sufficient to advance the carriage 17 five charater column spaces, and if a pulse were simultaneously applied to the solenoid 97 for the same period of time, the line feed mechanism 95 would advance the paper 18 by five corresponding line spaces, as the two movements are always correlated and synchoronized.

Further contributing to the uniqueness of the present line feed mechanism 95, as briefly touched upon hereinabove, is the fact that the dual pivotal armature 99 of the solenoid 97 also advantageously effects the release of the pivotal detent lever 141 from the ratchet wheel 144 after the commencement of each single line feed. In this manner, the platen is thereafter free to rotate for multiple line feeding, by simply maintaining the solenoid energized until the desired number of line feeds have been effected.

Figure 8:
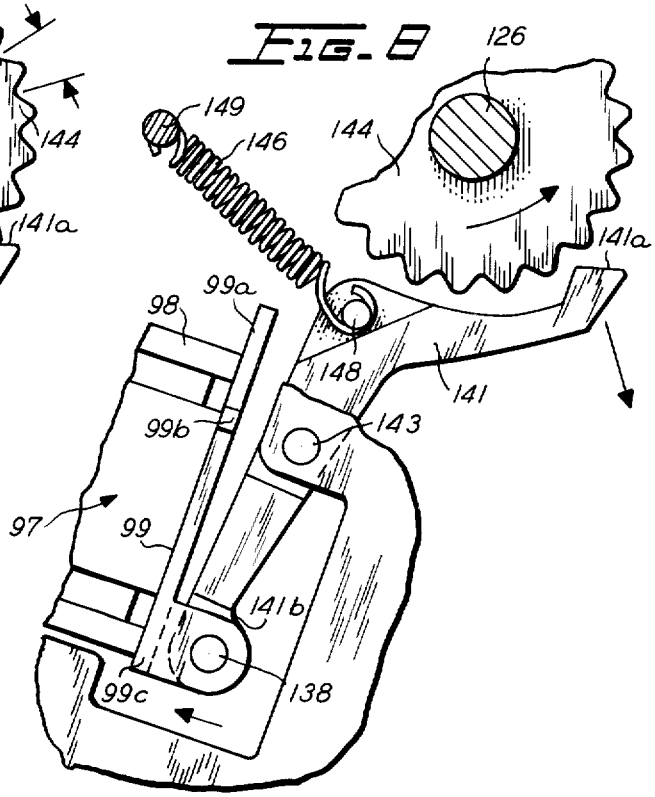

This detent lever release function is best illustrated in FIGS. 3, 7 and 8. With reference first to FIG. 3, it is seen that with the solenoid 97 de-energized, both ends 99*a* and c of the armature are spaced from the respectively associated core pole faces 98*a* and *b*. Thus, when the solenoid is initially energized, the upper end 99*a* of the armature, as previously described, is pivoted by magnetic attraction against the adjacent core pole face 98*a*. This, of course, results in the lever 105 being pivoted about its support shaft 118 (FIG. 5) so as to move the platen gear 102, mounted on the hub 121 thereof, into engagement with the intermediate gear 107. As a result, not only the platen 39 is rotated, but so is the ratchet wheel 144 secured thereto.

Upon the initial rotation of the ratchet wheel 144, the detent lever 141 is pivoted clockwise (as viewed in FIG. 7) about its support shaft 143. This is caused by the upper pawl end 141*a* of the detent lever being biased by the crest of the ratchet wheel tooth then in contact therewith. Such pivotal movement of the detent lever 141 causes the lower end 141*b* thereof to move the flange-coupled lower end 99*c* of the armature 99 into close proximity with the adjacent core pole face 98*b*.

At that point, the core pole face 98*b* of the then energized solenoid 97 further pivots the armature 99, together with the coupled detent lever 141, clockwise, by magnetic attraction, until the adjacent end 99*c* of the armature is rapidly drawn thereagainst, as illustrated in FIG. 8. In the latter position, it is seen that the upper pawl end 141*a* of the detent lever is positioned out of engagement with the teeth of the ratchet wheel 144.

Of course, as soon as a control pulse is removed from the solenoid 97, the armature 99 is released from both of the previously mating core pole faces 98*a* and *b*. As a result of the continuous counterclockwise directed spring-biased forces exerted against the platen gear lever 105 and detent lever 141, not only those parts, but the armature 99 and the platen gear 102 are then moved back to their relative positions selectively depicted in FIGS. 3 and 7.

The above described controllable disengagement of the detent lever 141 from the ratched wheel, as previously mentioned, is very important if very quiet multiple line feeding is to be realized, particularly in high speed printers wherein editing, vertical tabulating and/or formating operations are required. If the detent lever 141 were not disengaged from the ratchet wheel 144 during such operations, a rather loud and irritating clattering sound would be generated by the continuously rotating ratchet teeth successively contacting the detent lever spring-biased thereagainst. Moreover, if it were not for the use of the uniquely coupled and operated dual pivotal armature 99, separate cam-actuated and/or electromechanically actuated mechanisms would normally have to be employed in order to effect both variable platen rotation and detent lever release.

From the foregoing description of how the detent lever 141 is released from the ratchet wheel 144, it should be readily apparent that the line feed mechanism 95 lends itself to an alternative mode of operation for releasing the detent lever. More specifically, the size of the solenoid 97 could be chose, if desired, to produce a magnetic pull-in force at the pole face 98*b* (as well as at 98*a*) of sufficient magnitude to independently attract the lower end 99*c* of the armature thereagainst, i.e., from the position depicted in FIG. 7 to that in FIG. 8. As such, incremental rotation of the ratchet wheel would not even be required to initiate the clockwise pivotal movement of the detent lever 141 to the released position of FIG. 8.

This would normally not be a desired mode of operation because the coil spring 146 is necessarily chosen to produce a spring-biased force that causes the pawl end of the lever 141 to be firmly biased against the ratchet wheel 144 and, thereby, prevent platen rotation during line printing. Accordingly, the normal air gap that exists between the lower end 99*c* of the armature and the associated core pole face 98*b* (dependent in part on the root-to-crest-dimension of the ratchet teeth) would necessitate a rather large magnetizing force to overcome the spring-biased force, unless the air gap in question was partially reduced by the incremental rotation of the ratchet wheel.

Attention will now be directed to one preferred mode of operation of the line feed mechanism 95 embodied herein for a single line feed application. Assume initially that a given line of dot matrix characters have just been printed with the illustrative printer depicted in FIG. 1, and that the stepping motor 22 has been reversed, through suitable and conventional control circuitry (not shown), so as to drive the print head 16, through the lead screw coupled carriage 17, at a relatively high rate of speed to the left (X direction, as viewed in FIGS. 1 and 11) to the so-called "home" position. As depicted in FIG. 11, the "home" position is represented by the left-most line identified by the reference numeral 177, which position is chosen to be at least one character column space to the left of the normal print margin, represented by the line identified by the numeral 178.

Only after the print wires 24–30 of the print head 16 are positioned at this home position (line 177), is a control pulse applied to the solenoid 97 from the source 151 and immediately followed by a new signal applied to the stepping motor 22. Thereafter, as the carriagemounted print head 16 is advanced into alignment with the first dot position of the first character column (line 178), the platen gear 102 is driven by the then rotating intermediate gear 107. As a result, the platen 39 is incrementally rotated by an amount necessary to advance the paper 18 by one line space during the one non-printing character space advancement of the print head 16.

Concomittantly, the one non-printing character space advancement of the print head also normally allows it to be accelerated up to the desired speed in printers operating at very high printing rates with a constant, high speed (as distinguished from stepped) carriage. Also during the initial advancement of such a driven carriage, any backlash that may exist between the carriage drive nut (not shown) and the lead screw 20 would normally have been compensated for prior to the commencement of printing. If more time is required for such purposes, of course, two or more additional non-printing character column spaces may be utilized to the left of the normal print margin.

For the single line feed mode of operation under discussion, the control pulse applied to the solenoid 97 is preferably removed shortly before or at least when the print head 16 arrives at the first dot position of the first character print column (line 177 in FIG. 11). With the solenoid 97 then de-energized, the armature 99 thereof is released from magnetic attraction by the pole faces 98*a* and *b* of the core 98, and returned to the position depicted in FIG. 3. This results from the previously described spring-biased counterclockwise movements of the platen gear lever 105 and detent lever 141 to their respective non-actuated positions.

It is understood, of course, that after the single line feed control pulse has been removed from the solenoid 97, the control circuit for the printer would normally continue to apply either a continuous control signal (or pulsed signals) to the stepping motor 22, so as to either continuously drive or step the carriage-mounted print head 16 across the width dimension of the paper 18, until another carriage return signal is generated to effect the reversal of the motor. Such a signal is normally generated in conjunction with the input data signals processed for printing.

When more than one line feed advancement is required, the control pulse applied to the solenoid 97 is simply continued until the paper 18 has been advanced the desired number of line spaces. Advantageously, as previously pointed out, single or multiple line feeding may take place at any point along a given print line by simply energizing the solenoid 97 in a manner correlated with carriage advancement. In this connection, it should be readily appreciated that as the stepping motor 22 coupled to the lead screw 20 may be readily controlled by conventional circuitry for bi-directional rotation, so too may the quietly operated platen 39 be driven. As such, line feeding need not be dependent on either the position or the direction of travel of the carriage 17, or correlated in any manner with an end of line carriage return signal generated by associated control circuitry operating the print head.

To that end, it is obvious that the present line feed mechanism readily lends itself to high speed line feed applications wherein a sprocket feed (as distinguished from a frictional platen feed) is desired in order to effect, for example, "Form Out" and "Vertical Tab" functions, as well as other types of editing and/or printing functions, with precise line (and correlated character) space registration. As such, reference herein to a rotatably driven platen to effect line feeding is intended to encompass not only a frictionally engaging cylindrical platen per se, but also such a platen with one or more sprockets associated therewith for engaging and effecting the advancement of the print medium.

In summary, a unique line feed mechanism has been disclosed herein of compact, simplified, rugged and inexpensive design. This is made possible in large measure as a result of the peculiar use of and interrelationship between a line feed control solenoid with a dual pivotal armature and an operably responsive platen gear which forms part of a modified "Oldham" coupling. The present line feed mechanism also is designed to advantageously function in multiple and reversable line feed modes, and in a manner independent of carriage position, and with a very low degree of noise being generated.

In view of the foregoing, it is obvious that various modifications may be made to the present illustrative embodiment of the invention, and that a number of alternatives may be provided without departing from the spirit and scope of the invention.

What is claimed is:

1. In a high speed printer wherein a rotatable shaft mounted platen controls the advancement of a print medium in a correlated manner with the lateral line printing movement of a print head, the improvement comprising:

a line feed mechanism for selectively effecting single and logic controlled multiple line feeding, said mechanism including:

coupling means including a platen gear coupled to the shaft of said rotatable platen of the printer, said platen gear being mounted for eccentric movement relative to the axis of said platen shaft, while remaining continuously rotatably coupled thereto;

drive means including a rotatably driven drive gear;

first controllably displaceable means for rotatably supporting said platen gear about said platen shaft;

ratchet means positioned near one end of and rotatable with said platen;

second controllably displaceable means mounted so as to selectively engage said ratchet means; and operable line feed actuator means responsively coupled to both said first and second displaceable means, said actuator means when operated in a correlated manner with the lateral movement of the print head, causing said first means to be displaced from a first position whereat said platen gear is out of engagement with said drive gear to a second position whereat said gears are in coupling engagement, thereby causing said platen to rotate and advance a print medium engaged thereby, and said actuator means when operated further causing at least in part said second means to be displaced from a first position in resilient holding engagement with said ratchet means to a second position out of engagement with said ratchet means so as to release said platen for rotation.

2. In a high speed printer in accordance with claim 1, said drive means further including:

a second rotatable gear adapted for coupling both to a lead screw associated with the printer and with said first mentioned drive gear.

3. In a high speed printer in accordance with claim 1, said operable actuator means comprising a solenoid with a pivotal armature, the movement of said armature from a first position when the solenoid is de-energized to a second position when the solenoid is energized responsively causing at least said first means directly to be displaced from said first to said second position thereof.

4. In a high speed printer in accordance with claim 3, said first displaceable means comprising a first lever supported on an intermediate pivot, said lever having one end formed with an axially apertured hub on which said platen gear is rotatably mounted, with the other end being spring-biased against and cam-actuated by an associated end of said pivotal armature, and said second displaceable means also comprising a second lever supported on an intermediate pivot, with one end thereof normally being in springbiased contact with teeth formed in the periphery of said ratchet means, and the other end being coupled to the end of said armature opposite the cam-actuated end thereof associated with said first lever, said second lever thereby being pivotally responsive to the rotational movement of said ratchet means and to the movement of said armature when said solenoid is energized.

5. In a printer mechanism in accordance with claim 4, said coupling means, including the platen gear, comprising a modified Oldham coupling, and said ratchet means comprising a ratchet wheel secured to one end of the platen of the printer adjacent said platen gear.

6. In a high speed printer mechanism wherein a carriage-mounted dot matrix print head; having a plurality of selectively actuable and logic controlled print wires, is reciprocally driven back and forth in close proximity to and successively along different line printing paths extending across the width dimension of a print medium which engages and is driven by a rotatable shaft mounted platen, and wherein a reversible inked ribbon is interposed between the print head and the print medium for transferring dot matrix character images to and imprinting them on said medium while the latter is drawn taut against said platen, said combination further comprising:

a rotatably driven and selectively reversible lead screw coupled to said carriage for driving said print head reciprocably across the width dimension of said medium; and a line feed mechanism for periodically coupling said rotatable platen to said lead screw in a manner that correlates the lateral displacement of said carriage with both the angular displacement of said platen, and the linear advancement of said print medium engaged by and drawn over said platen, said line feed mechanism including:

coupling means including a platen gear coupled to the shaft of said rotatable platen of the printer, said platen gear being mounted for arcuate movement in a plane transverse to the axis of said platen shaft while remaining continuously rotatably coupled thereto;

drive means including a drive gear rotatably coupled to said lead screw and a second intermediate gear continuously coupled to said drive gear;

first controllably displaceable means for rotatably supporting said platen gear about said platen shaft;

ratchet means positioned near one end of and rotatable with said platen;

second controllably displaceable means mounted so as to selectively engage said ratchet means;

a selectively energizable solenoid having a dual pivotal armature, one end of said armature responsively engaging said first displaceable means and the opposite end of said armature being responsively coupled to said second displaceable means, said solenoid when energized in a correlated manner with the advancement of said carriage, causing said armature thereof to be displaced from a first to a second position and thereby causing said first means engaged therewith to be displaced from a first position whereat said platen gear mounted thereon is out of engagement with said intermediate gear to a second position whereat said gears are in coupling engagement, thus causing said platen to rotate with said drive and intermediate gears and advance the print medium engagingly drawn thereover, and the armature of said solenoid when energized further causing at least in part said second means coupled thereto to be displaced from a first position in engagement with said ratchet means to a second position out of engagement with said ratchet means so as to release said platen for rotation.

7. In a high speed printer mechanism in accordance with claim 6, said first displaceable means comprising a first lever supported on an intermediate pivot, said lever having one end formed with an oversized axially apertured hub on which said platen gear is rotatably mounted, with the other end being spring-biased against and cam-actuated by an associated end of said pivotal armature, and said second displaceable means also comprising a second lever supported on an intermediate pivot, with one end thereof normally being in spring-biased contact with teeth formed in the periphery of said ratchet means, and the other end being pivotally connected to the end of said armature opposite the cam-actuated end thereof associated with said first lever, said second lever thereby being pivotally responsive to the rotational displacement of said ratchet means and to movement of said armature when said solenoid is energized, and wherein said ratchet means comprises a ratchet wheel secured to one end of the platen of the printer adjacent said platen gear.

8. In a high speed printer in accordance with claim 6, said drive gear and platen gear being chosen to have diameters that result in said platen, when coupled to said lead screw, rotating by an amount which advances a print medium in contact therewith one line space for every character column advancement of said carriage, and wherein said lead screw has an axial length that allows said carriage to be advanced at least one character column space to the left of the normal first character print column of the printer, and wherein said solenoid is not energized on the return of said carriage until it is indexed said one space to the left of the first character print column, at which time the solenoid is energized to effect the rotation of said platen to advance said print medium by said one line space while said carriage advances said print head to the first dot position associated with the first dot matrix character print column.

9. In a high speed printer mechanism in accordance with claim 7, said platen gear of said coupling means being formed with an outwardly protruding pair of diametrically disposed and aligned integral ribs formed on one side surface thereof, said coupling means further including a drive member secured to the shaft of said platen, and having an outwardly protruding pair of diametrically disposed and aligned ribs formed on the side thereof nearest said platen, said coupling means further including an intermediate member having an oversized aperture adapted for mounting said member about and for allowing eccentric displacement thereof relative to the axis of said platen shaft, said intermediate member having a pair of diametrically disposed and aligned recesses formed in each side surface thereof, with the two pairs of recesses being orthogonally disposed relative to each other, and dimensioned so as to receive the respectively adjacent pairs of ribs formed in said platen gear and drive member on opposite sides thereof.

10. A compact, mechanically driven line feed printer mechanism for use in selectively rotating a platen to advance a print medium drawn thereover one or more line spaces at a time, said mechanism comprising:

coupling means including a platen gear adapted for coupling to an associated shaft of a platen, said platen gear being mounted for eccentric displacement relative to the axis of the platen shaft while remaining continuously coupled thereto;

drive means including a rotatably driven drive gear;

first controllably displaceable means for rotatably supporting said platen gear coaxially of said platen shaft;

ratchet means adapted for mounting on and rotation with the associated platen shaft;

second controllably displaceable means mounted so as to selectively engage said ratchet means; and selectively energizable line feed actuator means responsively coupled to both said first and second displaceable means, said actuator means when energized in a correlated manner with said driven drive gear, causing said first means to be displaced from a first position whereat said platen gear is out of engagement with said drive gear to a second position whereat said gears are in coupling engagement, thereby imparting rotational movement to the associated platen then coupled thereto, and said actuator means when energized further causing at least in part said second means to be displaced from a first position in resiliently holding engagement with said ratchet means to a second position out of engagement with said ratchet means so as to release the associated platen for rotation.

11. A line feed mechanism in accordance with claim 10 wherein said actuator means comprises a solenoid with a pivotal armature, the movement of said armature from a first position when the solenoid is de-energized to a second position when the solenoid is energized responsively causing at least said first means directly to be displaced from said first to said second position thereof.

12. A line feed mechanism in accordance with claim 11 wherein said first displaceable means comprises a first lever supported on an intermediate pivot, said lever having one end formed with an oversized axially apertured hub on which said platen gear is rotatably mounted, with the other end being spring-biased against and cam-actuated by an associated end of said pivotal armature, wherein said second displaceable means also comprises a second lever supported on an intermediate pivot, with one end thereof normally being in spring-biased contact with teeth formed in the periphery of said ratchet means, and the other end being pivotally connected to the end of said armature opposite the cam-actuated end thereof associated with said first lever, said second lever thereby being pivotally responsive to the rotational movement of said ratchet means and to pivotal movement of said armature of said solenoid when energized, and wherein said ratchet means comprises a ratchet wheel.

13. A line feed mechanism in accordance with claim 12 wherein said armature is mounted for controlled dual pivotal movement relative to two pole faces defined by the free ends of a U-shaped core of said solenoid, said solenoid when energized causing the cam-actuated end of said armature to be pivoted by magnetic attraction from a non-actuated position, spaced from an adjacent one of said pole faces, into a first pivoted position in contact with said one pole face, thereby causing said first lever to be displaced by cam-action from said first to said second position, to thereby effect the rotation of both said platen and said ratchet wheel when driven by said drive means, and said solenoid when energized, at least in cooperation with said ratchet wheel when rotated, further causing the coupled end of said armature to be pivoted, at least in part by magnetic attraction, from said first pivoted position, spaced from the other and adjacent pole face, into contact with said other pole face, whereby both pole faces are in contact with said armature, thereby, causing said second lever coupled to said armature to be displaced from said first to said second position.

14. A line feed mechanism in accordance with claim 12, further comprising a second drive gear adapted for mounting on and rotation with an associated lead screw of a printer, said second drive gear being positioned so as to be in continuous coupling engagement with said first mentioned drive gear, and wherein said platen gear of said coupling means is formed with an outwardly protruding pair of diametrically disposed and aligned integral ribs formed on one side surface thereof, said coupling means further including an angularly adjustable drive member secured to the shaft of said platen, and having an outwardly protruding pair of diametrically disposed and aligned ribs formed on the side thereof nearest said platen, said coupling means further including an intermediate member having an oversized aperture adapted for mounting said member about and for allowing eccentric displacement thereof relative to the axis of said platen shaft, said intermediate member having a pair of diametrically disposed and aligned recesses formed in each side surface thereof, with the two pairs of recesses being orthogonally disposed relative to each other, and dimensioned so as to receive the respectively adjacent pairs of ribs formed in said platen gear and drive member on opposite sides thereof.

15. In a printer having a rotatably driven drive gear, an improved line feed mechanism of the type responsive to a line feed signal for selectively effecting single or multiple line feed modes of a rotatable platen wherein the improvement comprises:

a rotatable gear, the axis of which is shiftable between first and second positions, the gear being normally out of engagement with the drive gear and generally concentric with the platen at the first axis position, and being in engagement with the drive gear and eccentric relative to the platen at the second axis position;

means for normally inhibiting free rotation of the platen;

coupling means for continuously coupling the gear to the platen for rotation therewith and for permitting the gear to rotate eccentrically relative to the platen;

means responsive to a line feed signal for shifting the gear axis to the second position to rotate the platen; and means responsive to a line feed signal which persists for a time longer than that required to effect the single line feed mode of the platen for disabling the inhibiting means so that the platen may freely rotate in the multiple line feed mode until cessation of the line feed signal.

16. The line feed mechanism of claim 15 wherein the shifting means comprises:

an armature one end of which is pivotable between first and second positions about a first pivot at its other end to move the gear axis between its respective first and second positions; and electromagnetic means for attracting the one armature and to its second position in response to the line feed signal, the other armature end being normally unattracted by the electromagnetic means.

17. The line feed mechanism of claim 16 wherein the inhibiting means and the disabling means comprise:

a lever pivotable on a fixed second pivot and pivotally connected at one end by the first pivot to the other of the armature, the other end of the lever normally resiliently and frictionally engaging the platen; and means responsive to rotation of the platen for pivoting the lever on the second pivot to move the other armature end, the one lever end and the first pivot proximate the electromagnetic means for attraction thereby so that the other lever end is disengaged from the platen.

* * * * *